US007348830B2

(12) United States Patent
Debroux

(10) Patent No.: US 7,348,830 B2
(45) Date of Patent: Mar. 25, 2008

(54) INTEGRATED CIRCUIT WITH AUTOMATIC START-UP FUNCTION

(75) Inventor: Jean-Francois Debroux, St Etienne de St Geoirs (FR)

(73) Assignee: Atmel Grenoble (FR)

( * ) Notice: Subject to any disclaimer, the term of this patent is extended or adjusted under 35 U.S.C. 154(b) by 0 days.

(21) Appl. No.: 10/568,866

(22) PCT Filed: Sep. 15, 2004

(86) PCT No.: PCT/EP2004/052179

§ 371 (c)(1),
(2), (4) Date: Jan. 8, 2007

(87) PCT Pub. No.: WO2005/031490

PCT Pub. Date: Apr. 7, 2005

(65) Prior Publication Data

US 2007/0146048 A1 Jun. 28, 2007

(30) Foreign Application Priority Data

Sep. 26, 2003 (FR) ..... 03/11322

(51) Int. Cl.
*G05F 1/10* (2006.01)

(52) U.S. Cl. ..... 327/538; 327/143

(58) Field of Classification Search ..... 323/315, 323/316; 327/143, 535, 538, 543
See application file for complete search history.

(56) References Cited

U.S. PATENT DOCUMENTS 4,890,052 A * 12/1989 Hellums ..... 323/315
6,060,918 A * 5/2000 Tsuchida et al. ..... 327/143
6,586,975 B2 * 7/2003 Nagaya et al. ..... 327/143
6,600,361 B2 * 7/2003 Nagaya et al. ..... 327/538
6,933,769 B2 * 8/2005 Koelling ..... 327/538
2001/0035776 A1 * 11/2001 Pavan ..... 327/103

FOREIGN PATENT DOCUMENTS

EP 0 515 065 A 11/1992
EP 0 619 647 A 10/1994

* cited by examiner

*Primary Examiner*—Jeffrey Zweizig
(74) *Attorney, Agent, or Firm*—Lowe Hauptman Ham & Berner, LLP

(57) ABSTRACT

The invention relates to integrated electronic circuits, and notably to those comprising analog functions. The invention relates more particularly to a starter circuit designed to ensure the automatic start-up of a biasing circuit following an interruption in the operation of the latter. The starter circuit comprises, in an integrated circuit substrate of a first type of conductivity comprising at least one well of an opposite type of conductivity and a semiconductor region of the same type of conductivity as the substrate, formed within the well and forming a p-n junction with the well, a first transistor, or transistor for detecting the operating condition of the biasing circuit, connected to the biasing circuit so as to be in the on state when the biasing circuit is operating normally and turned off when it is not operating normally, this transistor being placed in series with the p-n junction between two power supply terminals, the semiconductor region being connected to one of the power supply terminals, the drain of the first transistor being connected to the well by a conductor and being connected to the gate of a second transistor, or restart activation transistor, the second transistor being turned off by the switching on of the first transistor and being turned on by the existence of leakage currents in the p-n junction when the first transistor is in the off state.

7 Claims, 3 Drawing Sheets

INTEGRATED CIRCUIT WITH AUTOMATIC START-UP FUNCTION

FIELD OF THE INVENTION

The invention relates to integrated electronic circuits, and notably to those comprising analog functions.

BACKGROUND OF THE INVENTION

Circuits with analog functions, as opposed to purely logic circuits, often require the presence of biasing circuits that define sources of current with a well-defined value.

Typically, these biasing circuits use current mirror cells with feedback loops: a branch of the mirror imposes a current of forced value onto another branch that itself imposes a current of forced value onto the first branch. It is this type of feedback loop that allows a relatively stable operating condition to be defined, notably a current whose value is well defined with respect to temperature. Conventional biasing circuits are of the 'bandgap' type or of the PTAT (Proportional To Absolute Temperature) type.

Unfortunately, these biasing circuits have a drawback which is the random nature of their starting configuration at power up or after an abnormal interruption in operation (power supply power glitch or other interference). This random nature is explained by the fact that, aside from their stable operating point for which they exhibit the desired characteristics (in particular, as a function of temperature), they possess another undesirable stable operating point with zero, or virtually zero, current (in other words, an operating point different from that at which they must remain in normal operation). In the absence of power, or when power is re-applied, there is a risk of them staying at this undesirable operating point and not being able to spontaneously move away from it.

For this reason, it is desired to add an auxiliary starter circuit onto these circuits which forces a current to start flowing in the biasing circuit at the moment that power is re-applied, and which therefore forces this circuit toward its normal operating point by driving it away from the undesirable operating point.

Starter circuits used in this context are of two types:

- those which must be activated by a specific start-up command; these can have a low standby current consumption and a high current consumption during the start-up period which is very short; these circuits therefore have the advantage of drawing very little current in the steady state, but they have the drawback of not being able to start automatically when the power is re-applied;
- those which can start automatically in the presence of a power supply, whether that be at initial power-up or when the power is re-applied after a power glitch, or following any other interference event which might have interrupted the normal operation of the biasing circuit; these circuits generally have the drawback of drawing a non-negligible steady-state current.

The problem is that the current consumption is a parameter that is becoming increasingly important in many applications and especially in all applications that operate on small batteries (mobile telephones, etc.).

The aim of the invention is to provide a circuit for automatic starting which can both restart automatically at power up or following a power supply interruption and which draws very little current in the steady state.

SUMMARY OF THE INVENTION

The starter circuit according to the invention, designed to ensure the automatic start-up of a biasing circuit following an interruption in the operation of the latter, comprises, in an integrated circuit substrate of a first type of conductivity comprising at least one well of an opposite type of conductivity and a semiconductor region of the same type as the substrate, formed within the well and forming a p-n junction with the well,

- a first transistor, or transistor for detecting the operating condition of the biasing circuit, connected to the biasing circuit so as to be in the on state when the biasing circuit is operating normally and turned off in cases of abnormal operation, this transistor being placed in series with the p-n junction between two power supply terminals, the semiconductor region being connected to one of the power supply terminals, the drain of the first transistor being connected to the well by a conductor,
- a second transistor, or restart activation transistor, whose gate is connected to the drain of the first transistor, the second transistor being turned off by the switching on of the first transistor and being turned on by the existence of leakage currents from the junction when the first transistor is in the off state.

The principle of the invention may be broken down as follows:

- the first transistor may be considered as a mirror of the operation of the biasing circuit; if the latter operates normally, the first transistor is conducting; it conducts a current in a branch that fortunately draws a very low current because it only comprises the leakage path of the p-n junction; and when the first transistor is conducting it prevents the second one from conducting current;
- however, if the biasing circuit is turned off, then the first transistor is turned off; the presence of leakage currents of the p-n junction, higher than those of the first transistor, modifies the gate potential of the second transistor until it is turned on; when it conducts, it injects current coming from a power supply of the circuit toward the biasing circuit so as to force the latter to restart.

The condition is therefore that the p-n junction has a leakage current that is notably higher than that of the first transistor in normal operation, this condition bringing the gate of the second transistor toward a potential which makes the latter conduct.

For this reason, the p-n junction is preferably formed from several elementary junctions in parallel: several semiconductor regions of the same conductivity type as the substrate that are separate but electrically connected to one another form one pole of the junction; the well or wells form the other pole. If there are several separate wells electrically connected to one another, they comprise at least one semiconductor region diffused into each of them in order to form an elementary junction and the elementary junctions are connected in parallel to form the p-n junction as a whole.

In practice, it is provided that each well comprise two diffused semiconductor regions, separated by a gap overlaid by a gate which is electrically connected to these two regions, the assembly forming a transistor having its gate, its drain and its source joined together. This 'transistor' does not operate in transistor mode since all its electrodes are joined together, but it operates as two diodes in parallel, one formed between the well and the drain and the other between the well and the source. This transistor preferably has the same make-up and same dimensions as the first transistor or has dimensions that are multiples of those of the first transistor. There are preferably at least four (between four and ten) transistors thus configured as reverse-biased diodes, so as to ensure that the current leakages generated in this assembly of transistors be much higher than the leakages of the first transistor whatever the dispersion of the leakages of the various transistors formed on the integrated circuit.

BRIEF DESCRIPTION OF DRAWINGS

Other features and advantages of the invention will become apparent upon reading the detailed description that follows and which makes reference to the appended drawings in which.

DESCRIPTION OF PREFERRED EMBODIMENTS

Figure 1:
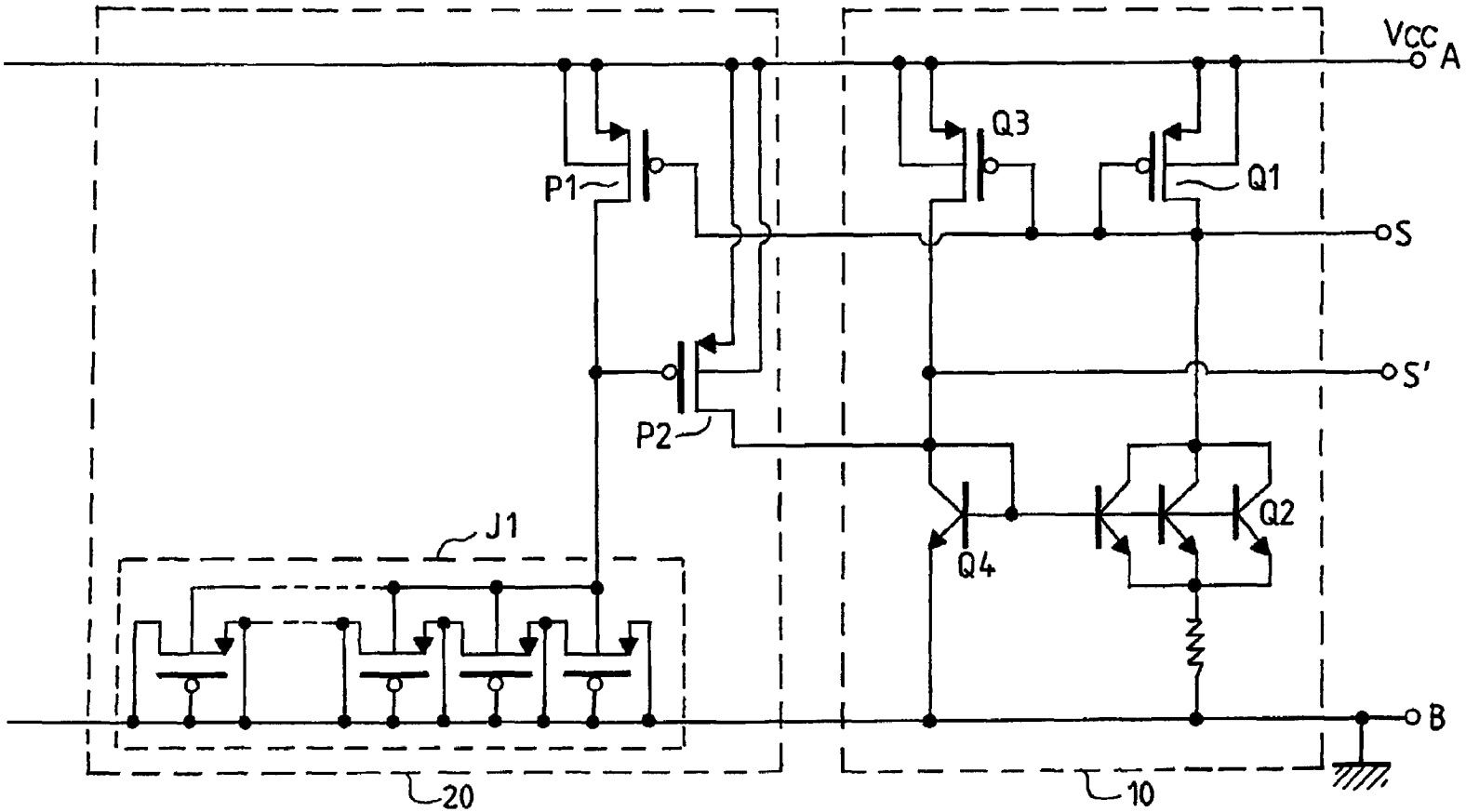
FIG. 1 shows the principle of the starter circuit according to the invention, which is associated with a biasing circuit given by way of example.

Within a dashed frame 10 on the right-hand side of FIG. 1, a biasing circuit of the conventional type is shown that is used as a current reference for other analog circuits (not shown) that form part of the same integrated circuit. Also, on the left-hand side within a dashed frame 20, the associated starter circuit is shown that is designed to force the biasing circuit to operate in its desired stable operating state so as to prevent it from remaining in a pseudo-stable state with zero, or virtually zero, current which would be an undesirable state.

The biasing circuit is only given by way of example. It is a circuit with two reciprocal current mirror branches in which each branch copies the current of the other branch. In this example, the circuit is one that supplies a current reference that is proportional to absolute temperature.

The first branch comprises a p-MOS transistor referenced Q1 having its gate connected to its drain and its source to a first power supply terminal A, this transistor Q1 being in series with an npn transistor Q2. As is shown in FIG. 1, the transistor Q2 can be composed of several transistors in parallel. The npn transistor Q2 has its emitter connected to a second power supply terminal B via an emitter resistor R2, its collector connected to the drain of the transistor P1 and to an output terminal S of the biasing circuit. The terminal B is a general ground terminal, and the terminal A receives a positive power supply voltage Vcc.

The second branch of the biasing circuit comprises a p-MOS transistor Q3 in series with an npn transistor Q4. The transistor Q3 is preferably identical to the transistor Q1 and it has its source and its gate connected to the source and the gate, respectively, of the transistor Q1 in order to copy, with copy ratio of unity, the current present in the transistor Q1. The npn transistor Q4 has its emitter connected to the terminal B without emitter resistor or with a smaller emitter resistor than the emitter resistor R of the transistor Q2; it has its collector furthermore connected to its base and to the base of the transistor Q2, and also connected to the drain of the transistor Q3. The transistor Q2 is larger than the transistor Q4 and it therefore tends to copy the current of the transistor Q4 with a copy ratio greater than 1.

This double current copying produces a stable operating point defining a reference current within each branch. This reference current can itself be copied by using the output S to drive the gates of other p-MOS mirror transistors, or an output S' taken from the base of Q4 to drive the base of other npn mirror transistors.

An example of biasing circuit using mixed bipolar/MOS technology has thus been described given that many analog circuits are built on this technology, but the bipolar transistors may be replaced by n-MOS transistors. Other examples of biasing circuits could be given.

In order to prevent this biasing circuit from remaining blocked in its undesirable stable state with zero, or virtually zero, current, the starter circuit according to the invention, shown in the dashed block 20, is adjoined to it.

In the remainder of the description, it will be considered that the integrated circuit is built on mixed bipolar and CMOS technology and is formed on a p-type semiconductor substrate within which n-type isolation wells are formed for the p-MOS transistors; the power supply terminal A is positive relative to the power supply terminal B which forms a general ground of the circuit. If the circuit were formed on an n-type substrate, the p-MOS transistors mentioned would be replaced by n-MOS transistors fabricated within isolated p-type wells, the bipolar transistors would be pnp and the power supply potentials would be reversed.

The starter circuit 20 firstly comprises a first p-MOS transistor P1 configured so that it tends to copy the current present in the branches of the biasing circuit. This is used to detect the normal operation of the biasing circuit in that it will be turned on if the transistors Q1 and Q2 are turned on (normal operation) and in that it will be turned off if the transistors Q1 and Q2 are turned off (biasing circuit not started despite the presence of a power supply voltage between the terminals A and B). The source of the transistor P1 is connected to the terminal A as are those of Q1 and Q3; its gate is connected to the gates of Q1 and Q3.

The transistor P1 is in series with a group of reverse-biased semiconductor p-n junctions in parallel whose function is to establish a leakage current path between the drain of P1 and the ground terminal B. These junctions are formed by semiconductor regions of the same conductivity type as the substrate, diffused into a well of the opposite conductivity type to that of the substrate. The well is connected by a conductor to the drain of the first transistor P1. The semiconductor regions diffused into the well are connected to the power supply terminal B. The junction formed between these semiconductor regions and the well is reverse biased and can only allow leakage currents to flow through this junction.

In practice, as will be explained below, these junctions can be fabricated in the form of transistors (drain and source separated by a gate) similar to the transistor P1. In FIG. 1, the junctions are globally denoted by the reference J1 and are formed from several transistors in parallel each having their source, their gate and their drain connected together and to the terminal B. These transistors are in a single well or in separate wells and, in this latter case, all the wells are connected to the drain of the transistor P1.

The first transistor, associated with the junction J1, is used to detect an abnormal situation requiring a restart. In order to activate this restart, a second transistor P2 is provided that has its gate connected to the drain of P1 and its source connected (directly in the case of FIG. 1, indirectly in the case of FIG. 3 as will be seen) to the power supply terminal A. The drain of this second transistor P2 is connected to the biasing circuit and allows a current to be injected into this circuit in order to cause it to restart when the transistor P2 is turned on. In the example of biasing circuit shown in FIG. 1, the drain of the restart transistor P2 is directly connected to the base and to the emitter of the npn transistor Q4 (configured as a simple diode) and it injects a current into this transistor Q4 which causes the biasing circuit to restart.

The circuit works as follows: if the biasing circuit does not restart following an interruption or glitch of the power supply, the current is zero, or nearly zero, in the branches of the biasing circuit current mirrors. The detection transistor P1 is configured so as to tend to copy the current in the transistor Q1; since this current is very low or zero, the transistor P1 will itself have a very low or zero current flowing through it. However, leakage currents exist within the transistor P1, notably a leakage current of the junction existing between the well (connected to the terminal A) of the transistor P1 and the drain of this transistor. In the presence of a power supply voltage Vcc on the terminal A, a leakage current flows from the terminal A to the drain of the transistor P1 then to the well of the junctions J1, this well being linked by a conductor to the drain of the transistor P1. From there, the leakage current can flow through the junctions J1 and go toward the ground terminal B.

The dimensions of the junction J1 are chosen such that the resistance to the leakage current flow is lower in the junction J1 than in the transistor P1. This is possible even though the leakage currents are not well known: it suffices to choose the dimensions of the junctions J1 to be large enough relative to the drain and source dimensions of the transistor P1 (for example, by employing several transistors in parallel for the junction J1, the size of each transistor being equivalent to that of P1, these transistors having their gate, their drain and their source linked together, the drain and the source forming with the well the desired junction).

The ratio of the leakage resistances of J1 and P1 means therefore that the gate potential of the transistor P2 gradually falls as the leakage currents flow, such that the p-MOS transistor P2 becomes conducting. The transistor P2 then injects a large enough current into the transistor Q4 to cause the biasing circuit to start up.

When the biasing circuit has started, the transistor P1 (which tends to copy the current present in the branches of the biasing circuit) tends to allow a much higher current than the leakage currents of the junctions J1 to flow. The ratio of the resistances to current flow of the transistor P1 and of the junction J1 is reversed and the gate potential of the transistor P2 recovers to a value that turns this transistor hard off.

The current drawn by the transistor P2 at start-up therefore ceases to be drawn after it has started. Only the leakage current of the junction J1 continues to be drawn, a current which represents a low steady-state consumption.

Figure 2:
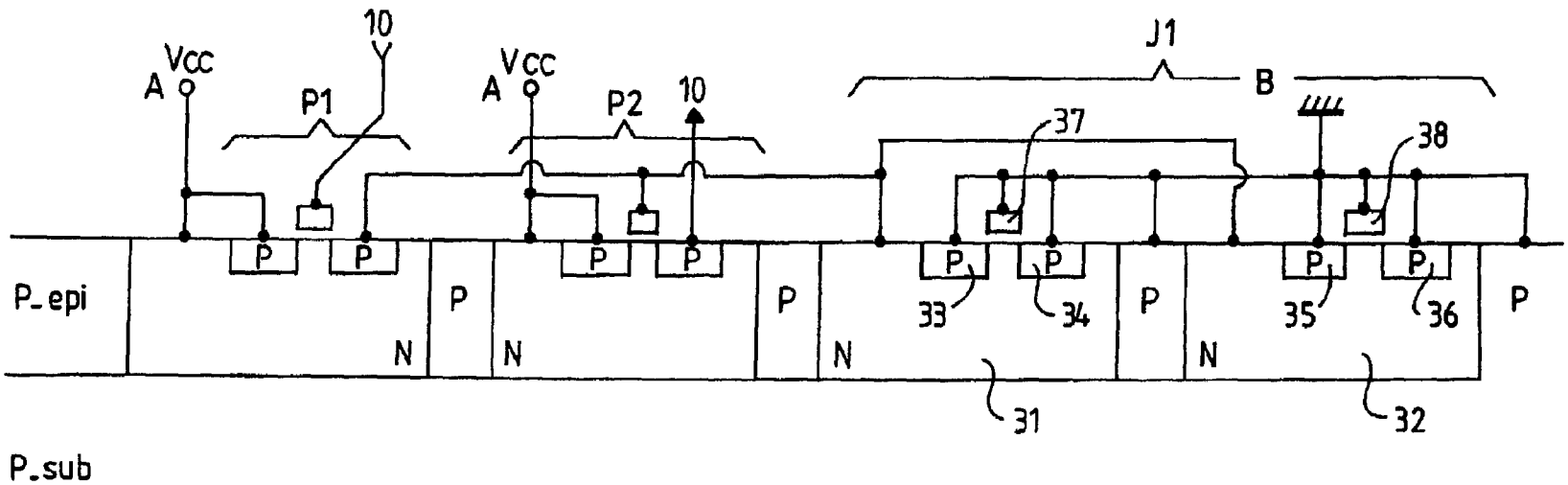
FIG. 2 shows a cross section of p-type integrated circuit substrate in which the starter circuit according to the invention is formed.

FIG. 2 shows a cross-sectional functional view of the integrated circuit substrate onto which the circuit according to the invention can be installed.

The substrate here is a p-type substrate into which n-type wells are diffused. The p-MOS transistors are formed within these wells.

The operation detection transistor P1 is formed within a well connected to the positive power supply terminal A. The source of P1 is connected to this terminal. The gate is connected to the biasing circuit 10 whose abnormal operation is desired to be detected in order to make it restart; more precisely, the gate of P1 is connected to the gates (not shown in FIG. 2) of the transistors Q1 and Q3.

The transistor P2 is formed within another n-type well, also connected to the terminal A; the source of P2 is connected to the terminal A; its gate is connected to the drain of the transistor P1; its drain is connected to the biasing circuit in order to force a restart current into this circuit; in accordance with FIG. 1, the drain of P2 is connected to the emitter and the base of the transistor Q4.

The junction J1 is formed here by two 'transistors' in parallel, situated within separate wells 31 and 32, but in practice, from four to ten transistors will preferably be used in parallel in order to ensure that, in spite of the dispersion of the leakage currents from one transistor to another, the leakage current of the junction J1 as a whole is greater than the leakage current of the transistor P1 in the off state. Each well of the junction J1 is connected to the drain of P1 and therefore to the gate of P2. Each of the two 'transistors' is formed by a p-type semiconductor drain region (33, 35) and source region (34, 36), these regions being separated by an n-type gap overlaid by a gate (37, 38); gate, source and drain of each 'transistor' are connected to the ground terminal B. The p-type semiconductor substrate in which the complete circuit is formed is also grounded via its front face and/or via its rear face.

Figure 3:
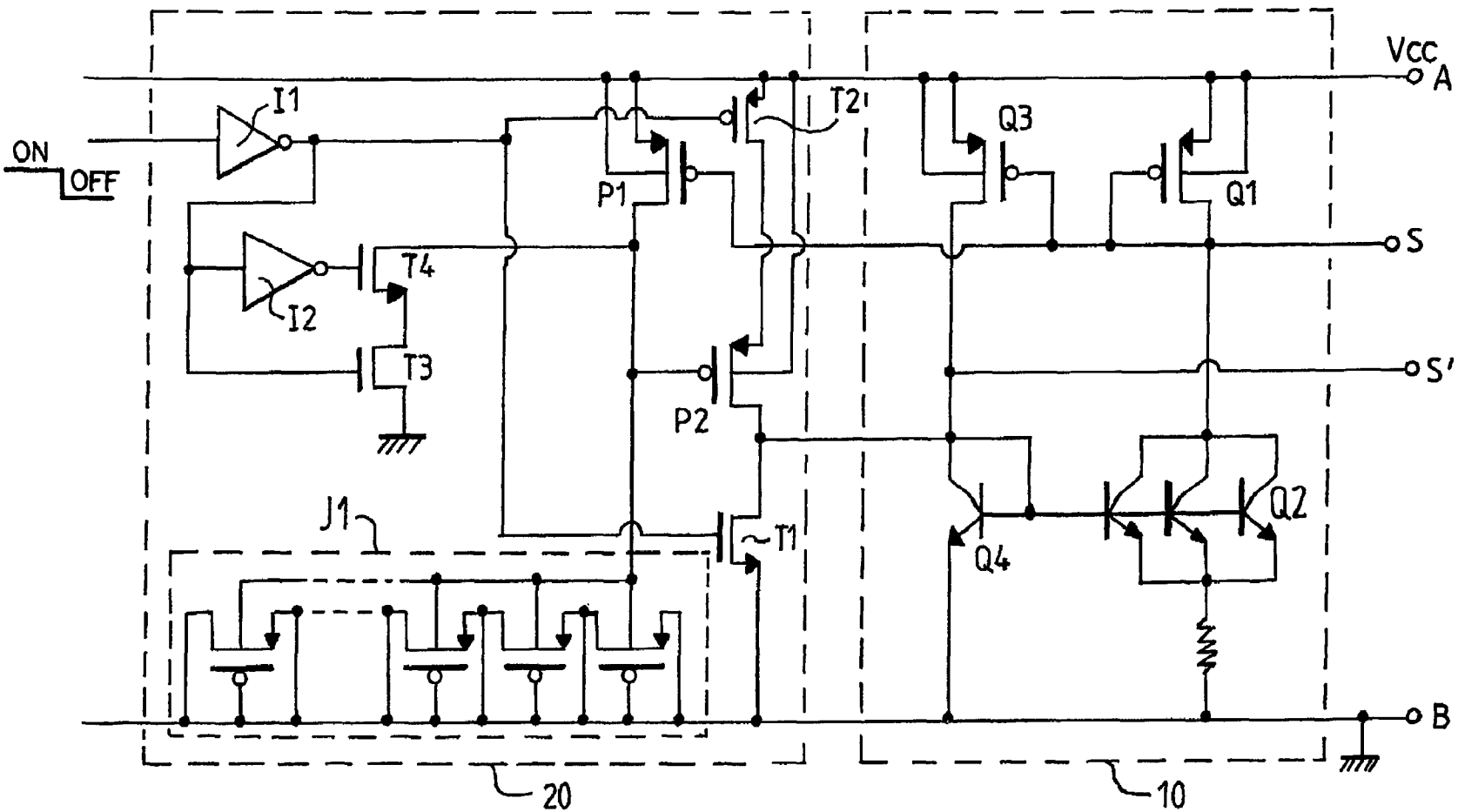
FIG. 3 shows the starter circuit according to the invention, slightly modified by addition of other elements when the biasing circuit whose ON/OFF must be controllable by a control signal.

FIG. 3 shows a circuit modification according to which a manual start-up and shut-down of the biasing circuit is available in addition to the automatic start-up. For example, it may be desired that the biasing circuit be purposely inhibited by pushing a button that supplies an ON/OFF logic signal in order to limit the quiescent power consumption despite the presence of a standby power supply Vcc between the terminals A and B. In this case of forced interruption of the biasing circuit, inverting the ON/OFF logic signal allows the circuit to be restarted.

For this purpose, the following disposition is preferably provided: an n-MOS transistor T1 has its source connected to the terminal B and its drain connected to the drain of the transistor P2; when it is in the on state, it short-circuits the base and the emitter of the transistors Q2 and Q4 of the two branches of the biasing circuit and prevents the operation (and the consumption of current) of the latter. The gate of the transistor T1 is connected to the output of an inverter I1 which receives an ON/OFF logic signal (ON at the high level, OFF at the low level) at its input; the application of the OFF signal turns on the transistor T1.

The output of the inverter I1 is also connected to the gate of a p-MOS transistor T2 which is placed in series between the terminal A and the source of the transistor P1. This transistor T2 is turned off by the OFF signal, at the same time as the transistor T1 is turned on. It prevents any current being drawn in 'stopped' mode by the transistor P2 and the transistor T1 which are turned on.

The inverter I1, the transistor T1 and the transistor T2 ensure that there is no power consumption with the biasing circuit in the off state.

In order to manually make the circuit restart more quickly in the case where it has been manually turned off (the slower automatic restart then being reserved for the cases of power supply interruption), a series assembly of two n-MOS transistors T3 and T4 is additionally provided, one transistor being controlled by the output of the inverter I1 and the other by the output of a second inverter I2 which itself receives the output of the first inverter I1. This series assembly is disposed between the gate of the activation transistor P2 and the ground B. It allows the gate of the transistor P2 to be grounded for a very short period of time (the reaction time of the inverter I2), which turns the latter on and instantaneously activates the start-up process. Outside of this short time period, at least one of the transistors T3 or T4 is in the off state and the series assembly of T3 and T4 draws no current and has no influence over the transistor P2. The short start-up activation time period occurs at the moment the ON/OFF signal goes to the high logic state for a manual start command: the transistor T3 becomes conducting at the moment of the inversion of the switch I1, while the transistor T4 is itself still in the on state since it only reacts after the slight delay introduced by the inverter I2. During the short period of time where both T3 and T4 are conducting, the gate of the transistor P2 is grounded and P2 turns on. This transistor turns off immediately afterwards.

This disposition in FIG. 3 in no way prevents an automatic restart in the case of an interruption of the power supply voltage as in the case of FIG. 1.

The invention claimed is:

1. A starter circuit designed to ensure the automatic start-up of a biasing circuit following an interruption in the operation of the latter, comprising: an integrated circuit substrate of a first type of conductivity comprising:

a well of an opposite type of conductivity and a semiconductor region of the same type of conductivity as the substrate, formed within the well and forming a p-n junction with the well, a first transistor, for detecting the operating condition of the biasing circuit, connected to the biasing circuit so as to be in the on state when the biasing circuit is operating normally and turned off in cases of abnormal operation, said transistor being placed in series with the p-n junction between two power supply terminals, the semiconductor region being connected to one of the power supply terminals, a drain of the first transistor being connected to the well by a conductor, a second transistor, or restart activation transistor, whose gate is connected to the drain of the first transistor, the second transistor being turned off by the switching on of the first transistor and being turned on by the existence of leakage currents from the p-n junction when the first transistor is in the off state.

2. The starter circuit as claimed in claim 1, wherein the p-n junction is formed from several semiconductor regions of the same conductivity type as the substrate that are separate but electrically connected to one another.

3. The starter circuit as claimed in claim 2, wherein the p-n junction comprises several separate wells electrically connected to one another, with at least one semiconductor region diffused into each well in order to form an elementary p-n junction within this well, the various elementary junctions thus being connected in parallel.

4. The starter circuit as claimed in claim 3, wherein each well comprises two diffused semiconductor regions, separated by a gap overlaid by a gate which is electrically connected to these two regions, the assembly forming a transistor having its gate, its drain and its source joined together.

5. The starter circuit as claimed in claim 4, wherein the transistor formed within the well and having its gate, its drain and its source joined together has dimensions that are multiples of the dimensions of the first transistor.

6. The starter circuit as claimed in claim 4, wherein the number of transistors having their gate, their drain and their source joined together and to the second power supply terminal is at least four.

7. The starter circuit as claimed in claim 5, wherein the number of transistors having their gate, their drain and their source joined together and to the second power supply terminal is at least four.

* * * * *